United States Patent [19]

Fujisawa et al.

[11] 4,426,929

[45] Jan. 24, 1984

[54] NUMBERING DEVICE FOR USE IN OFFSET PRINTING MACHINE

[75] Inventors: Nobuhiko Fujisawa, Fukuyama; Yoshiki Matsui, Hiroshima, both of Japan

[73] Assignee: Ryobi Ltd., Hiroshima, Japan

[21] Appl. No.: 392,913

[22] Filed: Jun. 28, 1982

Related U.S. Application Data

[63] Continuation of Ser. No. 151,852, May 21, 1980, abandoned.

[30] Foreign Application Priority Data

May 31, 1979 [JP] Japan ..... 54-74533[U]
Jul. 30, 1979 [JP] Japan ..... 54-105659[U]

[51] Int. Cl.[3] ..... B41F 13/56
[52] U.S. Cl. ..... 101/76; 101/226
[58] Field of Search ..... 101/76, 77, 84, 85, 101/183, 226, 409

[56] References Cited

U.S. PATENT DOCUMENTS

| | | | |
|---|---|---|---|
| 3,276,347 | 11/1965 | Bondley | 101/76 |
| 3,983,578 | 9/1978 | Price | 101/226 X |
| 4,000,691 | 1/1977 | Fischer | 101/183 X |
| 4,068,582 | 1/1978 | Poitons et al. | 101/76 |
| 4,202,268 | 5/1980 | Becker | 101/409 |

FOREIGN PATENT DOCUMENTS 1461926 1/1977 United Kingdom .

OTHER PUBLICATIONS

"In Line Numbering, Perforating and Slitting", Lithoprinter, Dec. 1974.

*Primary Examiner*—Edward M. Coven
*Attorney, Agent, or Firm*—Sughrue, Mion, Zinn, Macpeak, and Seas

[57] ABSTRACT

A numbering device for use in an offset printing machine includes a numbering-impression cylinder which is swingably disposed beside a transfer drum in order to perform a numbering operation simultaneous with an ordinary printing operation and to concurrently perform vertical and/or lateral perforation operations. The offset printing machine comprises a transfer drum positioned beside a main impression cylinder which confronts a blanket cylinder to perform ordinary printing operation; a numbering-impression cylinder; a numbering box supporting cylinder positioned beside the numbering impression cylinder so as to form numbers on a printed sheet, an ink supply in contact with the numbering box supporting cylinder; a perforating device positioned in confrontation with the numbering impression cylinder to provide vertical or longitudinal perforations in the printed sheet; and a synchronous mechanism connected between the cylinders in order to cooperate with a numbering box advancing device. Further, a lateral perforation cylinder can be provided in confrontation with the numbering impression cylinder in order to form lateral perforations in the printed sheet.

18 Claims, 15 Drawing Figures

NUMBERING DEVICE FOR USE IN OFFSET PRINTING MACHINE

This is a continuation of application Ser. No. 151,852, filed May 21, 1980, abandoned.

BACKGROUND OF THE INVENTION

This invention relates to a numbering device for use in an offset printing machine.

According to the conventional numbering device for use in the offset printing machine, the numbering device is accommodated in an impression cylinder of the printing machine to simultaneously achieve ordinary printing and numbering on the impression cylinder. In this type, however, since the impression cylinder is commonly used for both ordinary printing and numbering, a special mechanism is required to be installed in the impression cylinder. For example, since the distance between the central axis of a blanket cylinder and the central axis of a shaft for attaching the numbering device cannot be uniform relative to the central axis of the impression cylinder due to machining of mechanical parts, a paper or thin sheet is required to be wrapped around the impression cylinder in order to compensate the error.

In this case, reference numeral surface of a numbering device may bite into the sheet to create recessed portion, resulting in degrading the printing efficiency. In order to obviate this drawback, the sheet should be replaced with new one, which in turn, lowers workability and operabilities.

Another type of the conventional numbering device has been provided, wherein the numbering device is accommodated in a delivery section, so that the ordinary printing is achieved at the impression cylinder, and thereafter, number printing is achieved at the delivery section.

According to this type of device, since the numbering operation is achieved immediately before the fall of the printed sheet to provide printed stack, sheet to be subject to numbering is in an unstable condition. That is, the numbering operation is carried out at a chain-delivering portion, in which leading edge of the paper before numbering operation is merely supported by a delivery gripper, while the tail end of the paper is urged toward the direction of the falling, so that the paper may be corrugated or laterally displaced when the paper is about to be in numbering operation. Therefore, it would be almost impossible to accurately achieve numbering at the predetermined position of the sheet.

Further, the printed sheets such as slips and ledges are required to be subject to numbering as well as perforating or slitting operations. According to the conventional printing machine, after the number printing operation, the sheets are perforated by the independent perforating means or slitter, and therefore, the sheets must be reset at the perforating means, resulting in causing the entire operations to be troublesome.

SUMMARY OF THE INVENTION

It is therefore an object of the present invention to overcome the above-mentioned prior art disadvantages and to provide an improved numbering device. This object is attained in accordance with the present invention by providing an impression cylinder for numbering operation in addition to an impression cylinder for ordinary printing. Because of the provision of the additional impression cylinder, the ordinary printing is carried out independent of the numbering operation, and further, the numbering can be realized as in the same manner as that of the ordinary printing operation, to thus provide excellent numbering efficiencies.

Furthermore, according to the present invention, lateral or transverse perforations or slits are formed in the sheet at the numbering-impression cylinder. When the outer peripheral surface of the numbering-impression cylinder is suitably modified, the numbering operation as well as vertical and lateral perforating operations are simultaneously carried out.

The object of the present invention will become apparent from the description of the drawings and the preferred embodiment which follows.

DETAILED DESCRIPTION OF THE PREFERRED EMBODIMENTS

Figure 1:
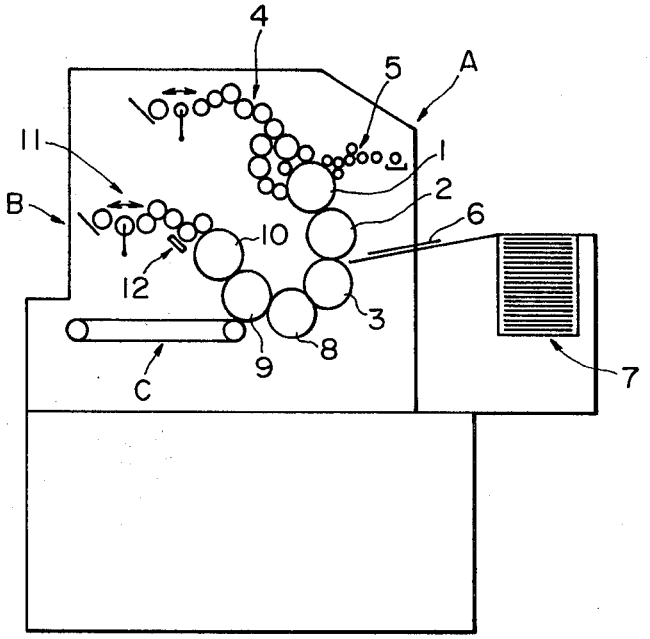
FIG. 1 is a schematic view of an offset printing machine incorporating a numbering device according to a first embodiment of the present invention.

Referring now to the drawings, and initially to FIG. 1, characters A, B and C designate a printing machine for ordinary printing, a numbering device and a delivery device, respectively.

The printing machine A includes a plate cylinder 1, a blanket cylinder 2, an impression cylinder 3, an ink supply portion 4, water supply portion 5 and a paper storage tray 7 for storing a paper 6. The ink supply portion 4 and the water supply portion 5 supply ink and water into an imaging portion of a printing plate (not shown) formed over the plate cylinder 1, and the impression cylinder 3 is provided with a grippers for transmitting the sheet 6 to a transfer drum mentioned later. Another structure is similar to those corresponding members of the conventional offset printing machine. Further the printing operation is the same as that conducted in the conventional offset printing machine, in which ink transferred onto the blanket cylinder 2 is transferred onto the sheet during the travel of the sheet along the path shown by an arrow of FIG. 2.

Figure 2:
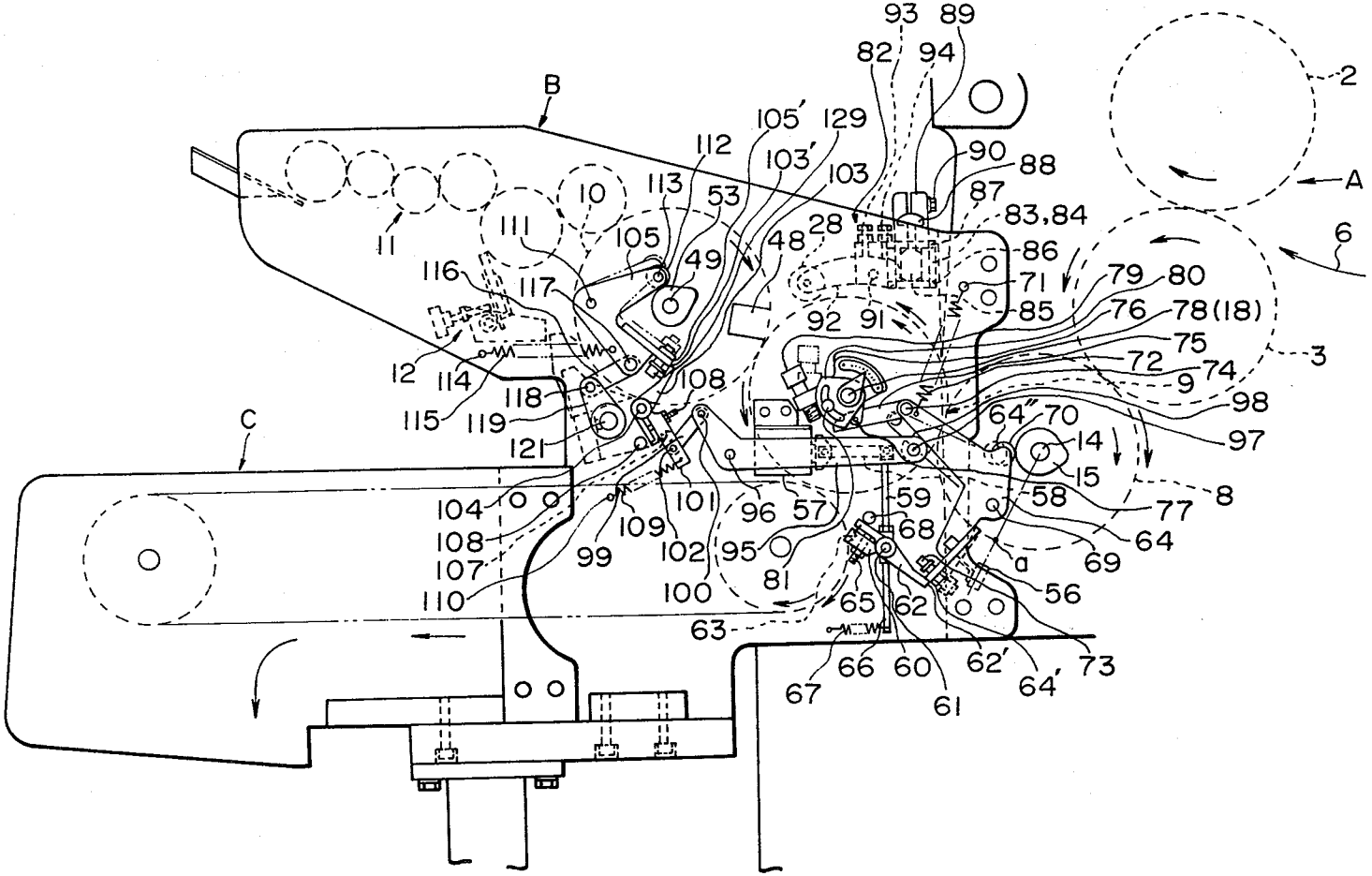
FIG. 2 is a fragmentary side view to show the numbering device according to the first embodiment of the present invention.

The numbering device B is positioned between the impression cylinder 3 of the printing machine A and the delivery device C. As shown in FIGS. 1 and 2, the numbering device B fundamentally includes a transfer drum 8, an impression cylinder 9 for number printing, a cylinder 10 for accommodating a numbering box, and an ink supplying device 11 having a roller cleaner 12. The transfer drum 8 is adapted to feed the printed paper 6 printed between the impression cylinder 3 and the blanket cylinder 2 into the impression cylinder 9 for numbering, as well as to permit the printed surface of the sheet 6 to confront with the peripheral surface of the cylinder 10 for accommodating the numbering box.

Figure 3:
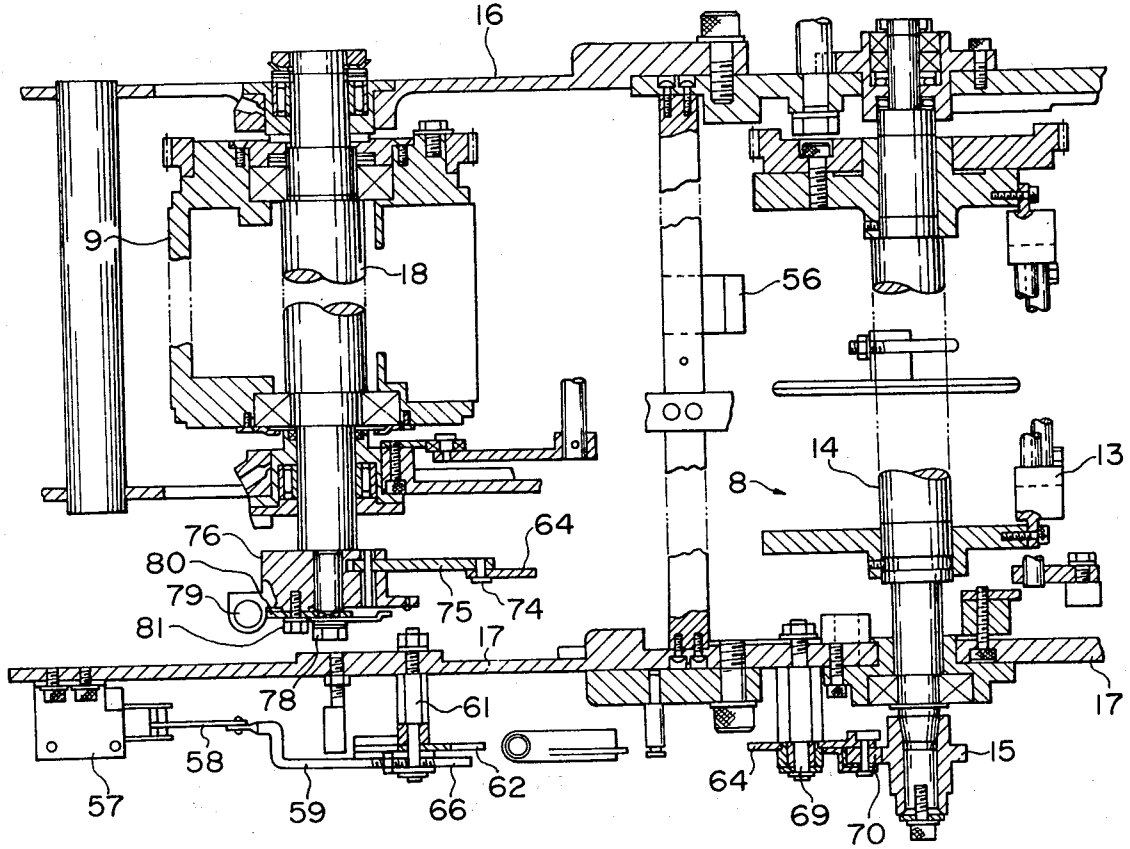
FIG. 3 is a plan view partially omitted showing an essential structure of the numbering device according to the first embodiment of the present invention.

In the transfer drum 8, as shown in FIG. 3, a gripper portion 13 is fixedly secured to a cylinder shaft 14 rotatably secured by frames 16, 17 through bearings. The gripper portion 13 is adapted to hold the leading edge of the printed sheet 6 in order to transfer the printed sheet 6 to the impression cylinder 9 for numbering. Further, a cam 15 is secured to one end of the cylinder shaft 14, and is rotated together with the rotation of the transfer drum 8 integrally rotated with the shaft 14.

Figure 4:
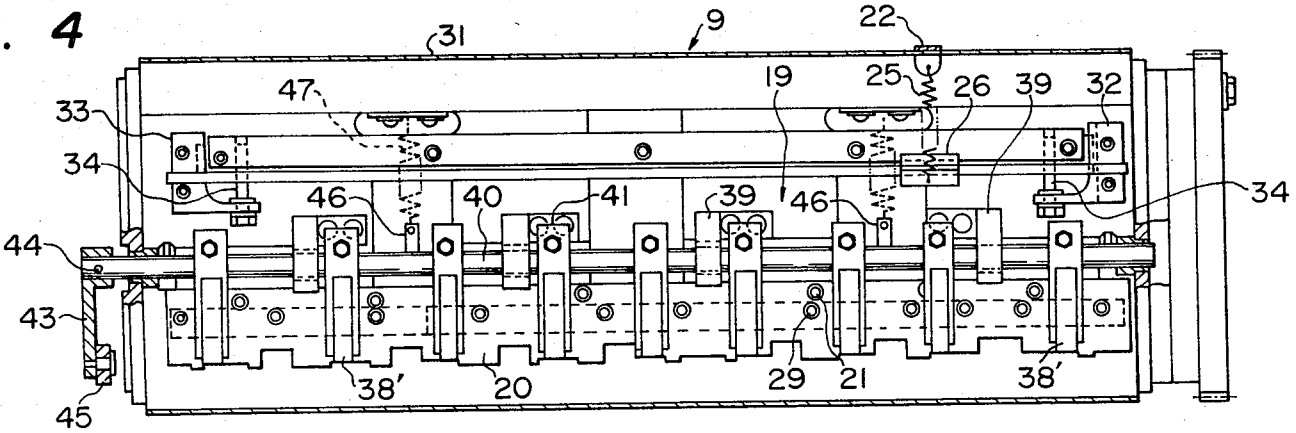
FIG. 4 is a longitudinal cross-sectional view of an impression cylinder for use in the numbering device of the present invention.
Figure 5:
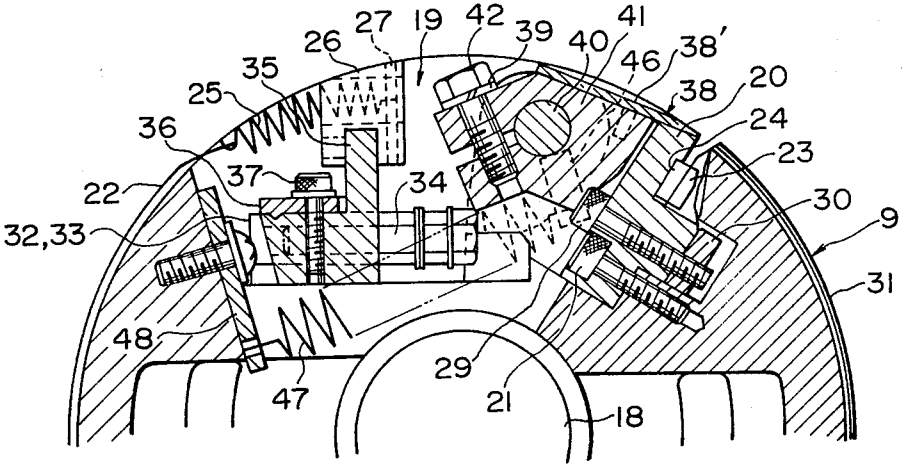
FIG. 5 is a transverse cross-sectional view partially cut away of the impression cylinder for use in the numbering device of the present invention.

The impression cylinder 9 for numbering is adapted to provide numbers on the printed surface of the sheet printed at the printing machine A, as well as to function as an underlay in case of the vertical perforating operation. The structure of the impression cylinder 9 is shown in FIGS. 4 and 5, wherein a shaft 18 is inserted into the impression cylinder 9 through bearing, and is rotatably supported by frames 16, 17. The shaft 18 is also swingably provided with respect to the frames 16, 17.

Figure 9:
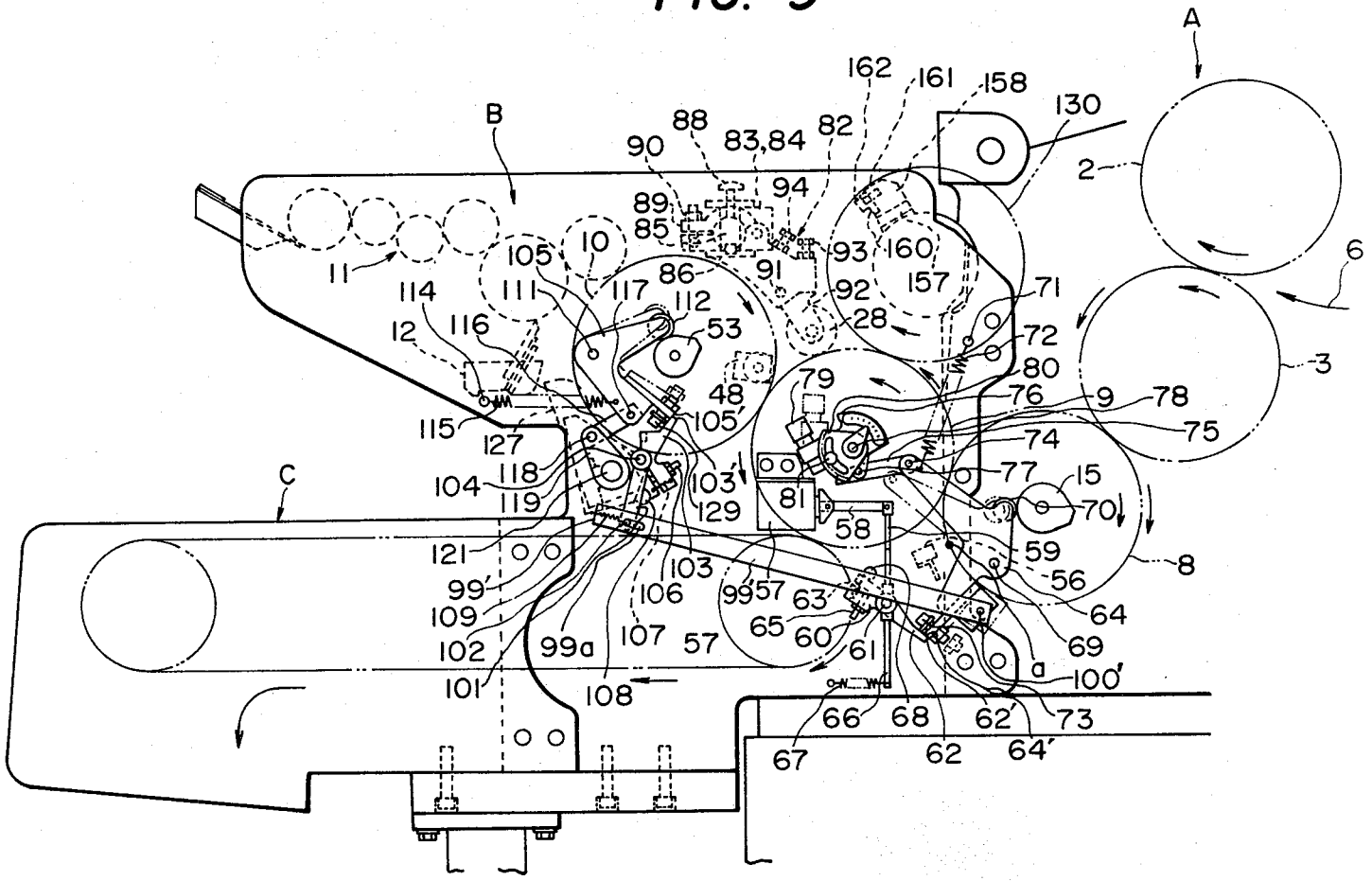
FIG. 9 is a fragmentary side view to show the numbering device and perforating device according to the second embodiment of the present invention.

According to the second embodiment shown in FIG. 9, the impression cylinder 9 for numbering is adapted to provide numbers on the printed surface of the sheet printed at the printing machine A, as well as to function as an underlay in case of the vertical and/or lateral perforating or slitting operation. In this case, a lateral perforation cylinder 130 is further provided in rotational contact with the impression cylinder 9.

The cylinder 9 is formed with a groove 19 along axial direction thereof, within which a gripper table 20 is fixed by means of bolts 21 in order to secure one end of a steel strip 22 formed over the cylinder 9 at fixing members 23, 24 slidably disposed along the axial direction of the cylinder 9. The other end of the steel strip 22 is formed with holes with which one end of spring 25 is engaged. The other end of the spring 25 is engaged with a pin 27 driven into an end portion of a bracket 26 slidably disposed along the axial direction of the cylinder 9, to thus normally urge the steel strip 22 toward the tail edge. As shown in FIG. 2, the steel strip 22 is in contact with a circular blade 28 adapted to provide vertical perforation in the sheet 6. The circular blade 28 can be replaced by a slitter roll in order to form longitudinal or vertical slits in the sheets.

The gripper table 20 is provided with a fixing piece 30 movable by the rotation of bolts 29, and between the gripper table 20 and the fixing piece 30, one end of an underlay 31 is secured which is formed of thin sheet for use in numbering, while the other end of the underlay 31 is fixed between a movable bar 35 and a clamping bar 36. The movable bar 35 is movably disposed along guide pieces 32, 33 by the rotation of a bolt 34, and the clamping force between the bars 35 and 36 is provided by a bolt 37.

The bolt 34 is provided so as to permit both underlay 31 and the steel strip 22 to closely contact the outer peripheral surface of the impression cylinder 9 for numbering. The underlay 31 is in close contact with entire peripheral surface of the cylinder 9, and the steel strip 22 having an axial width smaller than that of the underlay 31 is in close contact with the underlay 31 under tension. Thus, the numbering operation is achieved on the exposed surface of the underlay 31, and the vertical perforations are formed at the position on the steel strip 22 formed over the underlay 31. Further, the steel strip 22 can be displaced along the axial direction of the cylinder 9 as best shown in FIG. 4.

A gripper 38 is accommodated within the groove 19 in order to hold the sheet 6, to thus avoid displacement of the sheet during numbering operation, and to transfer the same to the delivery device C. The sheet 6 transferred from the transfer drum 8 is interposed at its tip end between the gripper 38' and the gripper table 20. The structure of the gripper 38 is described hereinbelow.

A bracket 39 is provided in the cylinder 9, and a shaft 40 extending therethrough is inserted through the bracket 39. Gripper-fixing tables 41 are fixedly secured to the shaft 40 by means of bolts 42 in order to secure each gripper 38' on each of the tables 41. One end of the shaft 40 is provided with an arm 43 secured thereto by means of a pin 44. The arm 43 is adapted to open and close the grippers 38' in response to the rotating displacement of a bearing 45 secured to the tip end of the arm 43. The bearing 45 is rotated in surface contact with a cam means (not shown), to thereby selectively open and close the grippers 38', to thus transfer the sheet 6.

Further, the shaft 40 fixes pins 46, with which each one end of springs 47 is fitted, while each other end of springs 47 is fitted with each of spring-fixers 48 fixed to the cylinder 9 by means of bolts, to thereby urge the grippers 38' toward the closing position thereof by the biasing force of the springs 47. Therefore, the sheet 6 is transferred from the impression cylinder 3 to sheet-discharge device C through the transfer drum 8, the impression cylinder 9 for numbering by the gripper table 20, grippers 38', gripper-fixing tables 41, shaft 40, arm 43 and the bearing 45.

Figure 14:
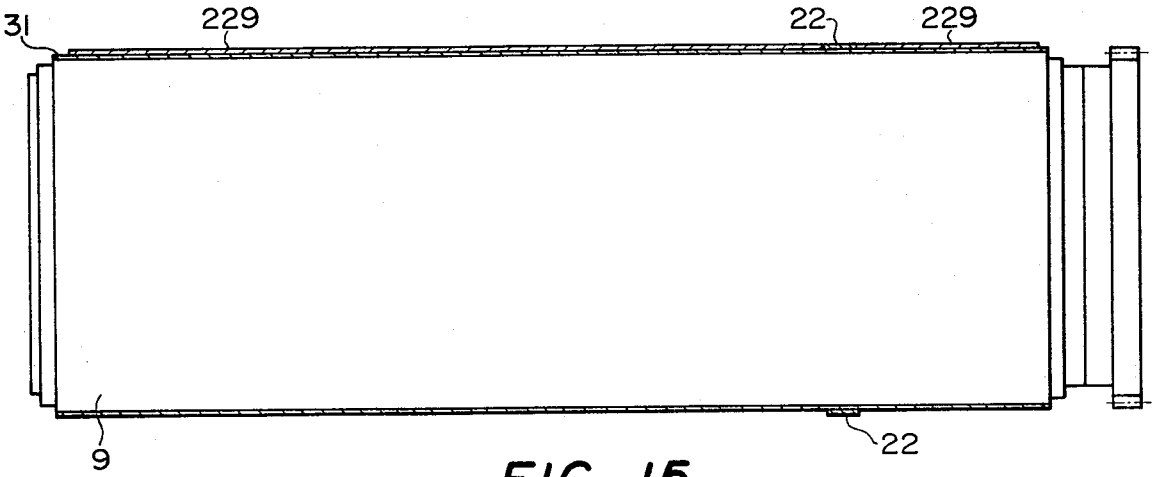
FIG. 14 shows a front view with partially cross-sectional view of the numbering-impression cylinder provided with an underlay and bands for lateral and vertical perforation according to the second embodiment of the present invention; and, FIG. 15 shows a partially cross-sectional view of a lateral-perforating cylinder according to an another embodiment of the present invention.
Figure 15:
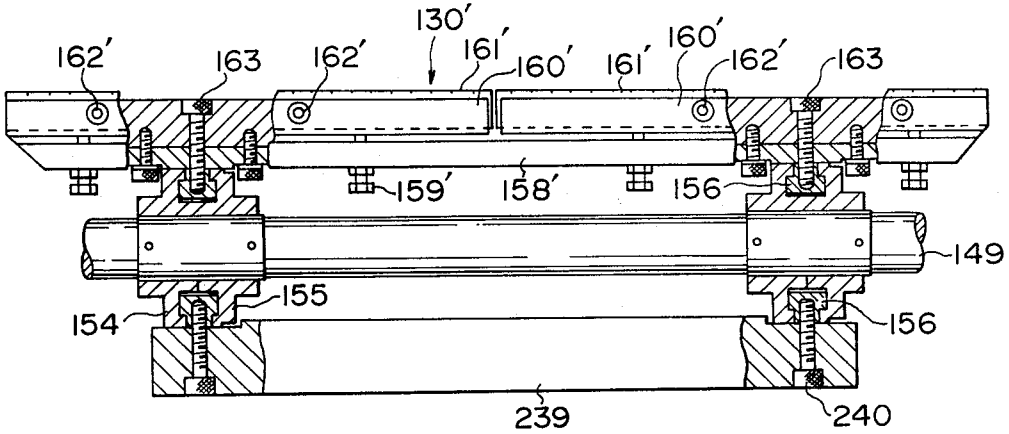

According to the second embodiment, in case of forming lateral perforations in the sheet, as shown in FIGS. 14 and 15, a band 229 is attached on the underlay 31 by means of, for example, a bifacial adhesion tape along the longitudinal direction of the cylinder 9. In this case, the underlay is previously printed with a grid-like pattern along the circumferential direction of the cylinder and the direction perpendicular to the circumferential direction thereof. The grid-like pattern is extremely useful for aligning the band 229 on the underlay, as well as for positioning a lateral blade 161 (mentioned later) for forming lateral perforations at the predetermined position relative to the underlay.

Further, in order to permit the band 229 together with the bifacial adhesion tape to be easily peeled from the underlay 31 without damaging the same for enabling re-use of these underlay and the band, the outer surface of the underlay 31 is laminated with a thermoplastic film.

Moreover, as shown in FIG. 14, steel band 22 is attached around the underlay 31, and the band 229 is cut into two pieces and is attached to the underlay 31 closely beside the steel band 22 in such a manner that the band 229 does not ride over the band 22. Therefore, the thickness and materials of the band 22 and 229 must be equal with each other.

Figure 6:
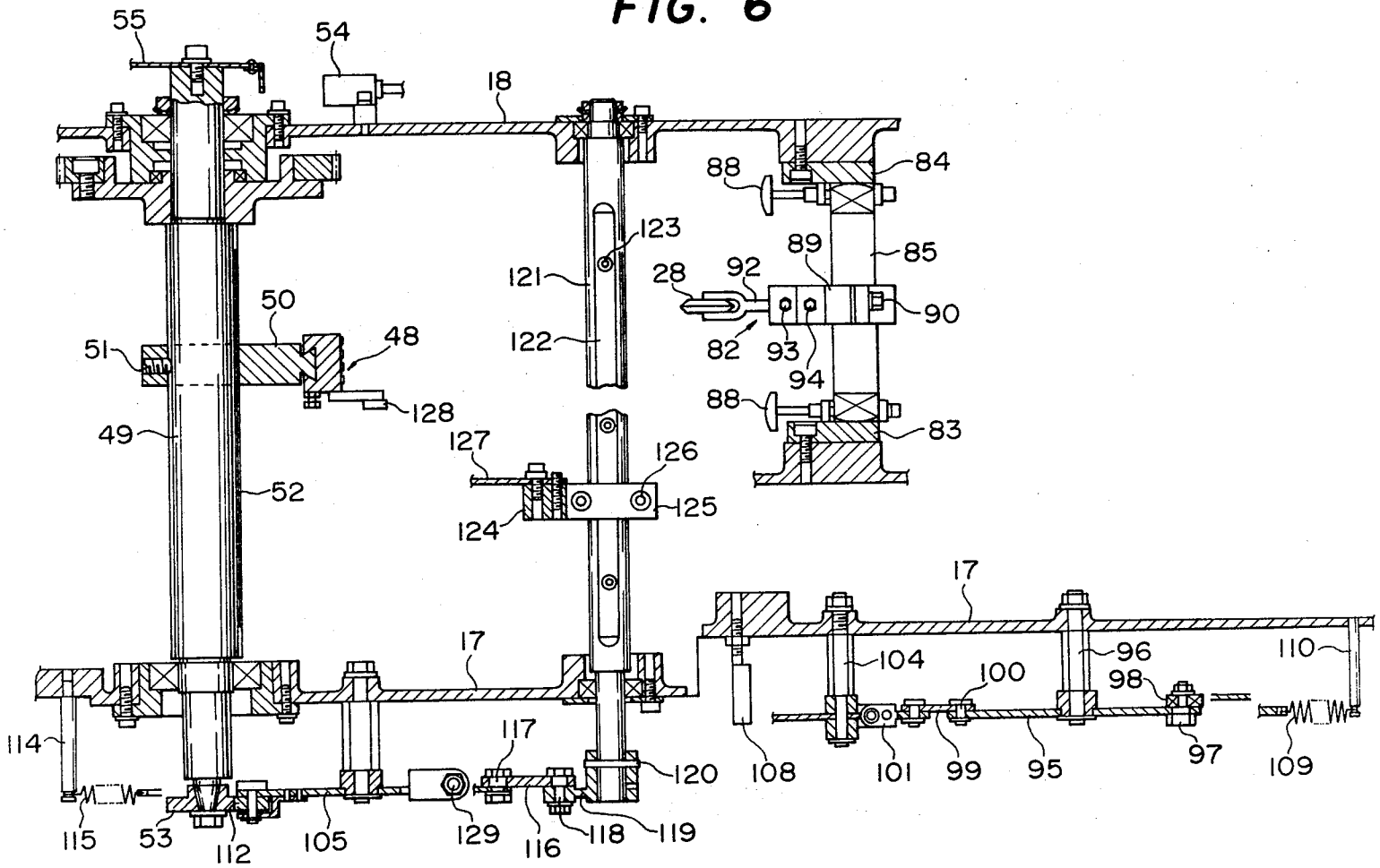
FIG. 6 is an explanatory illustration to show operational structure of the numbering system according to the present invention.
Figure 10:
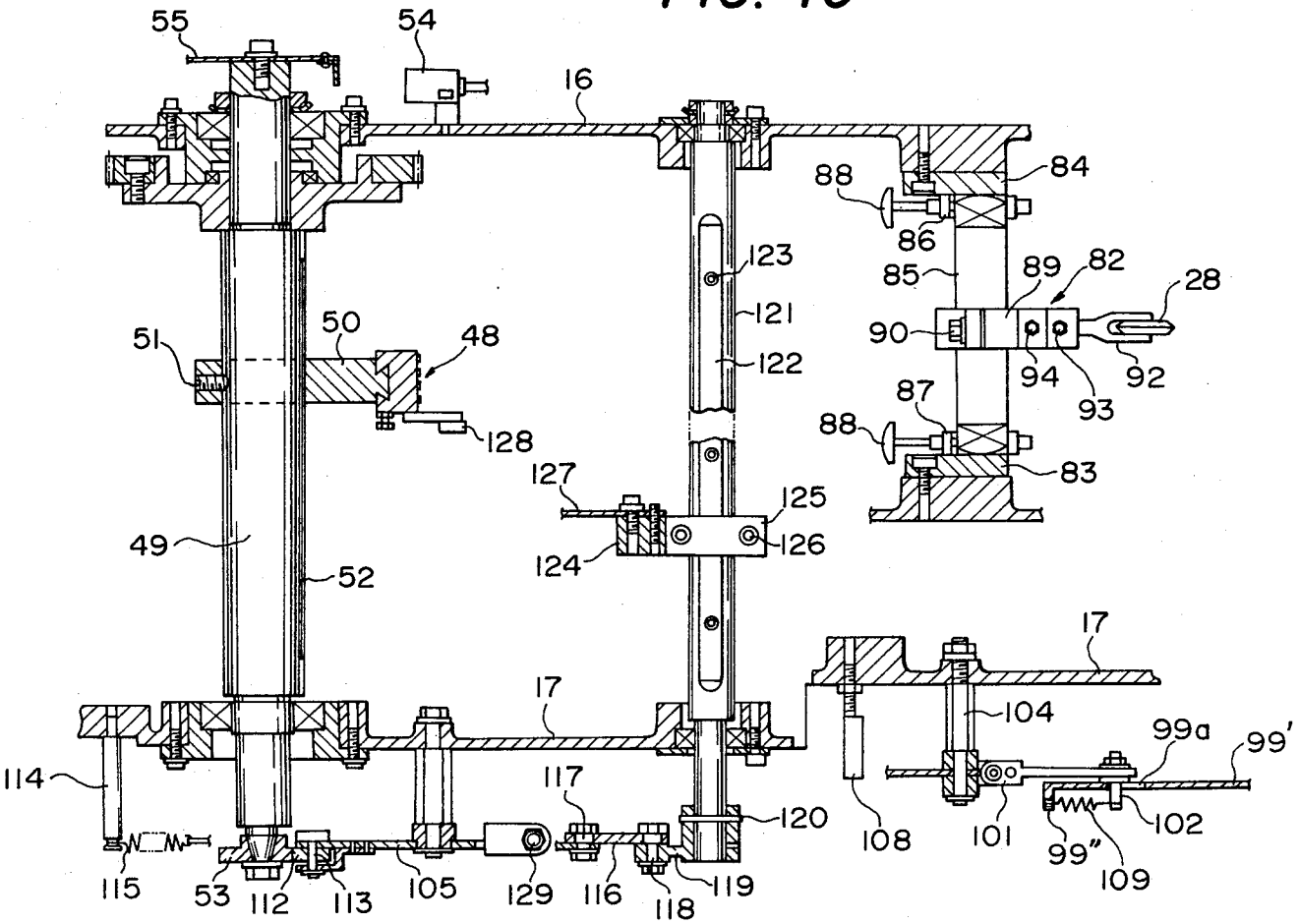
FIG. 10 is an explanatory illustration to show operational structure of the numbering and perforating systems according to the second embodiment of the present invention.

The cylinder 10 for accommodating a numbering box is provided with a numbering box 48. As best shown in FIG. 6 or 10, a ring 50 for attaching the numbering box 48 thereto is fixedly secured to a shaft 49 by means of a screw 51. The ring 50 is slidably disposed on the shaft 49 by unfastening the screw 51, and the position of the ring 50 is observed by a measure plate 52. The outer peripheral surface of the ring 50 can provide support for a plurality of the numbering boxes, to thereby perform numbering along longitudinal direction of the sheet. The shaft 49 is rotatably supported by frames 16, 17 through bearings, and the numbering box(es) 48 is integrally rotated together with the rotation of the shaft 49. The shaft 49 has one end provided with a numbering box-count-cam 53, and has the other end provided with a detection plate 55 rotated together with the rotation of the shaft 49. The detection plate 55 actuates a proximity switch 54 adapted to permit each of the mechanisms to be suitably operated in accordance with the position of the sheet 6.

Figure 11:
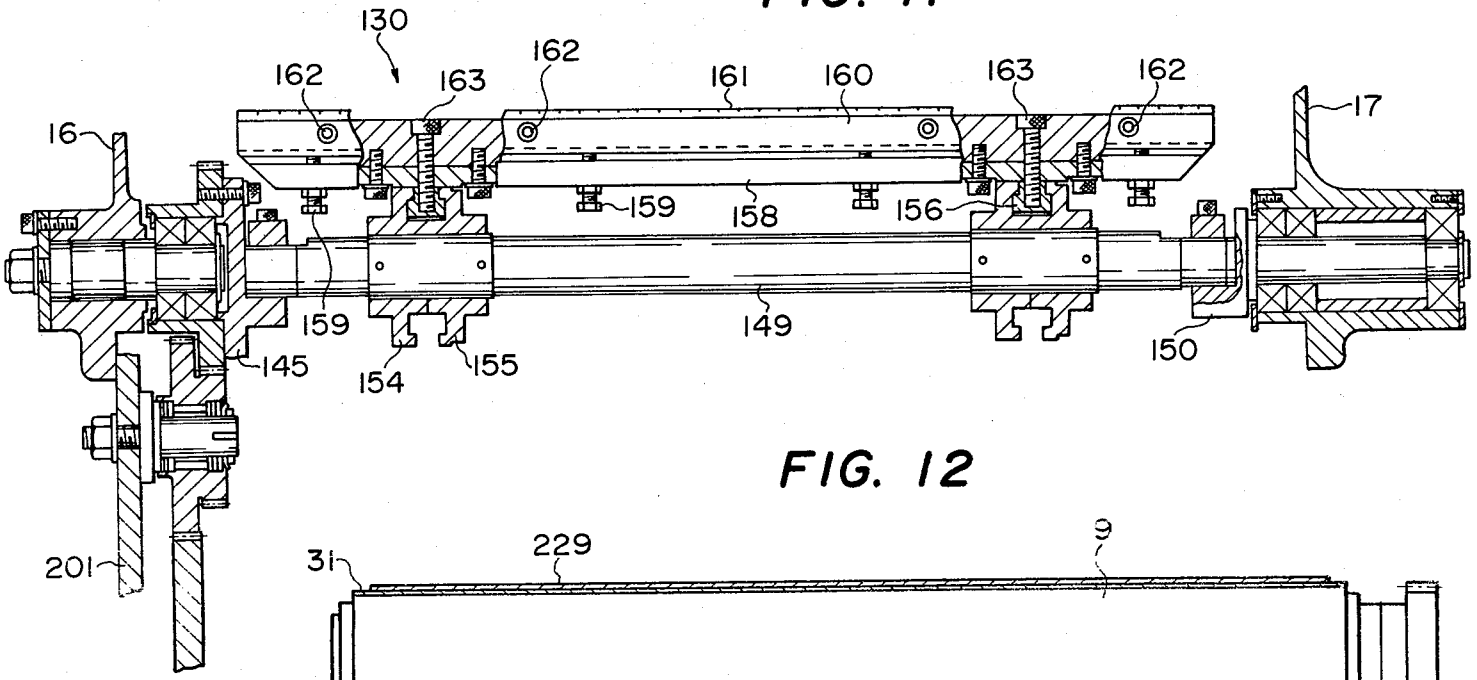
FIG. 11 is a longitudinal cross-sectional view showing a portion to be attached with a lateral blade according to the second embodiment of the present invention.
Figure 12:
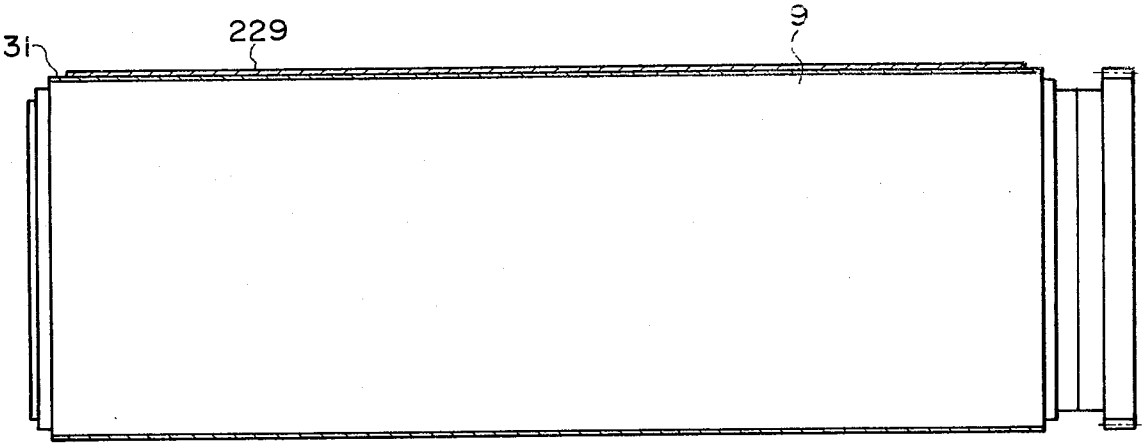

As shown in FIG. 11, a shaft 149 for lateral perforation means is detachably mounted to bracket 145, 150 each rotatably secured to frames 16, 17, respectively. The shaft 149 fixedly secures mount rings 154, 155 which define annular space with which T-shaped blocks 156 are slidably engaged. The blocks 156 are threadingly engaged with bolts 163 which secure a holder 158 for holding a lateral blade 161. Therefore, the blade 161 is secured to the shaft 149 at the suitable position by fastening the bolts 163.

The position of the lateral blade 161 is controllable by bolts 159. The blade 161 is fixedly secured to the holder 158 by bolts 162 through a support plate 160. The holder 158 can provide a plurality of lateral perforation blade 161. If no formation of the lateral perforations is required, a cylinder 130 for attaching lateral perforation forming means can be removed together with the shaft 149.

Upon rotation of the shaft 149, the lateral perforation blade 161 is brought into contact with the sheet 6 held by the numbering impression cylinder, to thereby form lateral perforations along the direction in parallel with the cylinder 9.

FIG. 15 shows another embodiment of the means for forming lateral perforations, wherein like parts and components are designated by the same reference numerals as those shown in FIG. 11. According to this embodiment, subdivided blades 161′ are secured to the holder 158′ by bolts 162′ through subdivided support plate 160′. Further, a reinforcing rod 239 is secured to the shaft 149 through the mount rings 154, 155 by bolts 240 at the position in rotational symmetry with respect to the holder 158′. The reinforcing rod 239 serves to function as a counter-balance weight relative to the holder 158′ as well as to provide sufficient rigidity of the lateral perforation cylinder 130. The mount rings 154,155 can hold a plurality of blade holders 158′.

Next, explanation is made in terms of the operational sequence and associated structures, after the completion of the ordinary printing. (After the ordinary printing, the sheet is subject to numbering and is mounted on the delivery device.)

The sheet 6 is transferred from the sheet-storage-tray 7 to the main impression cylinder 3 by means of a sheet-feeder (not shown), and the impression cylinder 3 holds the leading edge of the sheet 6. On the other hand, ink is supplied from the ink-supply portion 4 of the printing machine A into the imaging portion of the printing plate formed over the plate cylinder 1, and the supplied ink is transferred into the blanket cylinder 2, whereat the sheet 6 held by the impression cylinder 3 is subject to ordinary printing upon the sheet being passed between the impression cylinder 3 and the blanket cylinder 2, and thereafter, the sheet is delivered to the transfer drum 8.

When the leading edge of the sheet 6 reaches a point "a" shown in FIG. 2, the photoelectric sensor 56 detects the leading edge of the sheet 6, to thus actuate a solenoid 57. The front end of the solenoid 57 pivotally connects one end of a link 58, the other end of which is pivotally connected to one end of a swing-arm 59. The other end of the swing-arm 59 is connected to a clutch boss 60 by means of a fastening nut.

The clutch boss 60 is rotatably secured to a stud 61. Further, a clutch 62 is pivotally supported by the stud 61, and therefore, the clutch 62 and the clutch boss 60 are swingable about the stud 61. A biasing spring 63 is connected between the rear end of the clutch 62 and the clutch boss 60 in order to provide a predetermined distance between the tip end 62′ of the clutch 62 and one end 64′ of an operation arm 64 mentioned later. Further, the distance between the tip end 62′ and the one end 64′ of the arm 64 is controllable by an adjusting screw 65 mounted on the clutch boss 60. For example, the distance becomes large by the rightward rotation of the adjusting screw 65, whereas the distance becomes small by the leftward rotation thereof.

A spring 67 is connected between the frame 17 and a tip end of an arm 66 fixed to the clutch boss 60 in order to normally urge the tip end 62′ of the clutch 62 toward the direction opposite to the one end 64′ of the operation arm 64. Further, a stopper 68 is normally contacted with the rear end of the clutch 62. Upon actuation of the solenoid 57, the solenoid is retracted against the biasing force of the spring 67, to thereby provide the contact between the front end 62′ of the clutch 62 and the one end 64′ of the operation arm 64.

The operation arm 64 is pivotally mounted on a stud 69. The operation arm 64 has a second end 64″ provided with a roller 70 which is in contact with a cam 15 integrally secured to the cylinder shaft 14 of the delivery cylinder 8. The operation arm 64 has a third end connected to one end of a spring 72, the other end of which is connected to a pin 71. Thus, by the rotation of the shaft 14, the cam 15 is rotated to urge the roller 70, to thereby swing the operation arm 64 about the stud 69, resulting in engaging the front end 62' of the clutch 62 with a stopper pin 73 secured to the first end 64' of the operation arm.

The third end of the operation arm 64 mounts a pin 74 to which one end of a link 75 is pivotably secured. The other end of the link 75 is pivotably secured to a block 76 through a pin 77. The block 76 is connected to one end of the eccentric shaft 18 of the numbering-impression cylinder 9 by means of a bolt 78 through a rotatable worm gear 79 and a worm wheel 80 for adjusting the eccentric position of the shaft 18. The worm wheel 80 is fitted to the shaft 18 through a key, so that even if the bolt 78 is unfastened, free rotation of the wheel 80 relative to the shaft 18 is prevented.

Upon determination of the eccentric position of the shaft 18 by the worm gear 79, the worm wheel 80 is fastened by a bolt 81 in order to avoid the displacement of the eccentric position (see FIGS. 2 and 3). Owing to the control of the eccentric position of the shaft 18, the distance between the shaft 18 and the shaft 49 of the cylinder 10 is controllable in accordance with the thickness of the sheet.

That is, the operation arm 64 is swingable by the cam 15, so that the link 75 is reciprocatingly moved, to thereby swing the eccentric shaft 18 through the block 76. When the roller 70 of the operation arm 64 reaches the highest position of the cam 15, the shaft 18 is at the nearest position to the numbering box-attaching cylinder 10, whereupon the tip end 62' of the clutch 62 engages the stopper pin 73 of the operation arm 64. At this time, the solenoid 57 is energized to retract the same, upon the detection of the tip end of the sheet 6 by the photoelectric sensor 56.

In case where the sheet is not fed, the solenoid 57 is not energized, so that the tip end 62' of the clutch 62 is not engaged with the stopper pin 73 of the operation arm 64. In this case, the operation arm 64 is repeatedly swung because of the rotation of the cam 15, so that the numbering impression cylinder 9 is repeatedly swung until the photoelectric sensor 56 detects the tip end of the sheet 6.

When the photoelectric sensor 56 detects the leading edge of the sheet 6, the solenoid 57 is energized, so that the tip end 62' of the clutch 62 is brought into contact with the first end 64' of the operation arm 64 to provide engagement of the clutch with the stopper pin 73. Since the operation arm 64 is always swung, the engagement of the clutch is given when the roller 70 contacts the highest position of the cam 15, whereupon the numbering-impression cylinder 9 is at the nearest position to the numbering box-attaching cylinder 10. This positional relationship is maintained unchanged. (This position is referred to "waiting state for numbering".)

The sheet 6 is transferred from the transfer drum 8 to the numbering-impression cylinder 9, and then the perforations are formed in the sheet 6 by the blade 28 of a perforating means 82, the structure of which is described below.

In the perforating means 82, as shown in FIGS. 2 and 6, brackets 83, 84 are secured to the frames 16, 17, and a pair of supporting plates 86, 87 are attached to the brackets 83, 84 by bolts in order to secure a perforation shaft 85 therebetween. A knob bolt 88 is provided at the central portion of the supporting plate 87 to fixedly secure the perforation shaft 85. Further a bracket 89 is insertably mounted on the shaft 85, and is fixedly secured thereto by a bolt 90. An arm 92 is pivotally secured to a pin 91. The arm 92 rotatably secures the rotary blade 28 at its front end. The pressing force given between the blade 28 and the numbering-impression cylinder 9 is controllable by the threading movement of the bolts 93 and 94.

The sheets 6 are continuously transferred, and the numbering box 48 is so designed as to perform a numbering operation upon every single sheet being passed therethrough. The structure is as follows.

According to the first embodiment shown in FIG. 2, an arm 95 is pivotally secured to a stud 96, and has one end provided with a roller 98 rotatably secured to an eccentric pin 97. The roller 98 is always contacted with the operation arm 64. The other end of the arm 95 is provided with a pin 100 to which one end of a link 99 is pivotally secured. The other end of the link 99 is rotatably secured to a clutch boss 101 by a pin 102.

On the other hand, according to the second embodiment shown in FIGS. 9 and 10, a linear link 99' has one end pivotally connected to a stud 100' fixed to the arm 64, and has the other end formed with an elongated slot **99*a* with which a pin 102 is slidingly engaged. The pin 102 is fixed to a clutch boss 101 mentioned later. A spring 109 is connected between the other end 99'' of the link 99' and the pin 102 in order to normally urge the tip end 103' of a clutch 103 away from a tip end 105' of an operation arm 105**.

In FIG. 2, the clutch boss 101 is rotatably secured about a stud 104, around which a clutch 103 is also rotatably secured. The distance between the one end 103' of the clutch 103 and a first end 105' of an operation arm 105 is controllable by an adjusting screw 106 and a spring 107 connected between the clutch boss 101 and the clutch 103. For example, the distance increases by righthand rotation of the adjusting screw 106, while the distance decreases by lefthand rotation thereof. The spring 107 serves to provide a predetermined distance between the one end 103' of the clutch 103 and the first end 105' of the operation arm 105. Further, a stopper pin 108 is contacted with the clutch 103, to thereby maintain the distance between the ends 103' and 105'. Furthermore, a biasing spring 109 is connected between a stud 110 and the clutch boss 101, so that the roller 98 of the arm 95 is normally urged toward the operation arm 64 to maintain surface contact therebetween.

The operation arm 105 is rotatably secured to a stud 111 and has a second end provided with a pin 113 to which a roller 112 is rotatably secured. The operation arm 105 is connected to one of a spring 115, the other end of which is secured to a pin 114, so that the roller 112 is urged toward a numbering cam 53 fixedly secured to one end of the numbering box-shaft 49, to thus maintain surface contact between the roller 112 and the cam 53.

Further, the operation arm 105 pivotally connects one end of a link 116, the other end of which is rotatably secured to one end of an arm 119 through a pin 118. The other end of the arm 119 is fixedly secured to one end of a shaft 121 of the numbering box count cam by means of a pin 120 (FIGS. 2 and 6).

As shown in FIG. 6 (first embodiment) or FIG. 10 (second embodiment), the numbering box count cam shaft 121 is mounted for oscillation. A guide key 122 is secured to the shaft 121 by bolts 123, and a block 124 and a hold-plate 125 are secured to the shaft 121 by means of a bolt 126. The block 124 and the plate 125 interpose the guide key 122 and the shaft 121 therebetween. A numbering box operation cam 127 is secured by a bolt to the block 124, in order to advance the numbering box 48. In case of the continuous numbering operation, continuous counting is carried out by the surface contact between a roller 128 rotatably secured to an arm of the numbering box 48 and a cam surface of the operating cam 127.

Upon completion of the perforating operation conducted between the numbering impression cylinder 9 and the perforating means 82, the numbering operation is carried out. That is, according to the first embodiment during the engagement of the clutch 62 with the stopper pin 73, the roller 98 in contact with the operation arm 64 is urged downwardly in the drawing, to thus cause the tip end 103' of the clutch 103 to be rotated in counter-clockwise direction in the drawing, so that the tip end 103' is brought into contact with the first end 105' of the operation arm 105.

On the other hand, the roller 112 of the operation arm 105 is urged upwardly when the highest portion of the cam 53 is contacted therewith. In this case, the operating cam 127 is rotated in the clockwise direction. The sheet subjected to numbering is transferred to the delivery device C to form a printed sheet stack.

In the second embodiment, upon completion of the perforating operation conducted between the numbering impression cylinder 9 and the perforating means 82, the numbering operation is carried out. That is, during the engagement of the clutch 62 with the stopper pin 73, the link 99' is urged toward right in FIG. 9. so that the tip end 103' is brought into contact with the first end 105' of the operation arm 105.

On the other hand, the roller 112 of the operation arm 105 is urged upwardly when the highest portion of the cam 53 is contacted therewith simultaneous with the interlocking between the stopper pin 129 and the tip end 103' of the clutch 103. In this case, the operating cam 127 is rotated in the clockwise direction. The sheet subjected to numbering is transferred to the delivery device C to form a printed sheet stack.

During the rotation of the printing machine, if the sheet supply is stopped, the solenoid 57 is deenergized because of non-detection of the sheet 6 by the photoelectric sensor 56, so that the tip end 62' of the clutch 62 is disengaged from the stopper pin 73 secured to the first end of the operation arm 64. Because of this disengagement, the operation arm 64 becomes swingable. This swinging movement of the operation arm 64 causes the arm 95 to move upwardly (first embodiment) or causes the link 99 to move leftwardly (second embodiment) to thereby disengage the tip end 103' of the clutch 103 from the stopper pin 129 mounted on the first end of the operation arm 105. In this case, cams 15 and 53 are continuously rotated toward the same direction. The operation arms 64 and 105 are repeatedly swung until the next sheet is delivered to the position "a" shown in FIGS. 2 and 9.

It should be noted that the diameters of the blanket cylinder 2, main impression cylinder 3, delivery cylinder 8, numbering-impression cylinder 9, the numbering box-attaching cylinder 10 and the lateral perforation cylinder 130 are equal to one another.

Figure 7:
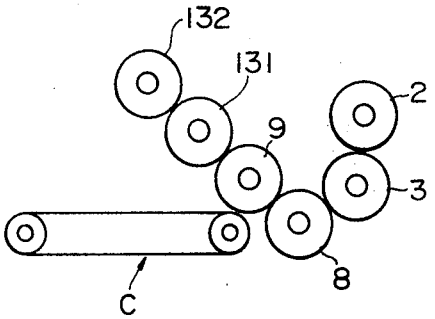
FIG. 7 shows another example of arrangements of cylinders according to the present invention.
Figure 8:
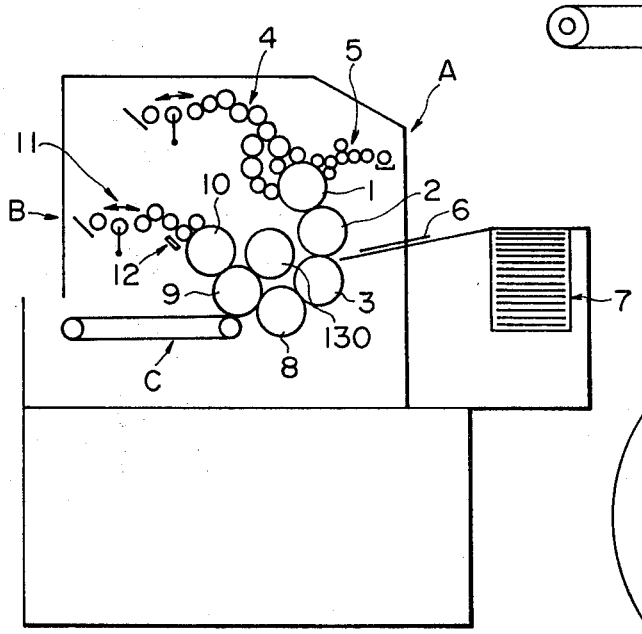
FIG. 8 is a schematic view of the offset printing machine incorporating numbering and perforating devices according to a second embodiment of the present invention.
Figure 13:
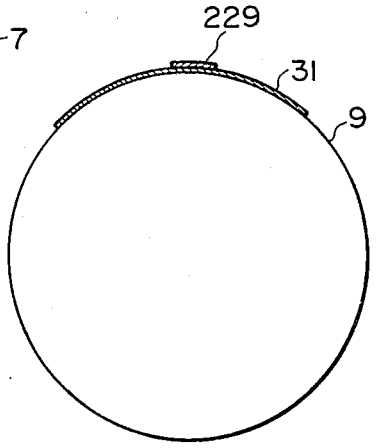
FIGS. 12 and 13 show a front view and side view with partially cross-sectional illustration of an impression cylinder provided with an underlay for numbering and a band for lateral perforation, respectively according to the second embodiment of this invention.

Further, according to the present invention, instead of the numbering box 48, an imprinting plate is employable in order to realize imprinting operation. Furthermore, as shown in FIG. 7, the numbering box-attaching cylinder 10 can be replaced by additional blanket cylinder 131 and plate cylinder 132, so that two-tone color printing is realized.

As mentioned the above, according to the present invention, since numbering-impression cylinder 9 is provided in addition to the main impression cylinder 3, the numbering operation is carried out without damaging to the surface of the main impression cylinder 3. Further, the numbering impression cylinder 9 functions as an underlay for the sheet during numbering operation (the sheet is stably interposed between the cylinders 10 and 9 and between the cylinders 8 and 9), so that the corrugation of the sheet during numbering and perforating operations can be obviated, and lateral and vertical perforations can be formed in the sheet simultaneous with the numbering formation in a stabilized manner.

Furthermore, the numbering-impression cylinder 9 is swung in synchronism with the numbering box counting operation by the provision of the operation arms 64,105, clutches 63, 103 and link 99, etc., upon energization of the solenoid 57 in response to the detection of the front end of the sheet at the predetermined position of the delivery cylinder 8, so that in spite of the independent employment of the two impression cylinders 3 and 9, stabilized numbering operation is successively carried out simultaneous with the successive ordinary printing, to thus enhance printing efficiencies.

Since the lateral perforation cylinder 130 is synchronizingly rotated with respect to cylinders 8, 9 and 10, the lateral perforations can be formed in the sheet at the predetermined position thereof by the confrontation of the lateral perforation blade 161 (161') onto the band 229. Therefore according to the present invention, lateral perforations can be formed in the sheet without deteriorating or degrading the numbering operation and vertical perforating operation.

While the invention has been described in detail and with reference to specific embodiments thereof, it will be apparent to one skilled in the art that various changes and modifications can be made therein without departing from the spirit and scope thereof.

What is claimed is:

1. An offset printing machine including a plate cylinder, a blanket cylinder, an impression cylinder confronting the blanket cylinder to perform ordinary printing operation, an ink supplying portion adapted to supply ink into a plate formed over the plate cylinder, and a sheet-delivery means comprising:

(a) a transfer drum (8) positioned beside the impression cylinder (3), said transfer drum having a sheet holding means (13) in order to hold leading edge of a printed sheet (6), (b) a numbering-impression cylinder (9) swingably positioned beside the transfer drum (8), (c) an eccentric shaft rotatably supporting said numbering-impression cylinder (9) and a sheet holding means (38, 38', 20, 40, 43, 45) disposed in a groove (19) formed in the numbering impression cylinder (9), (d) a numbering box supporting cylinder (10) positioned beside the numbering impression cylinder (9), the numbering box supporting cylinder (10) accomodating a numbering box (48) adapted to form numbers on the printed sheet (6) transferred between the numbering box supporting cylinder (10) and the numbering-impression cylinder (9), said numbering-box supporting cylinder (10) further including a rotatable shaft (49) having one end provided with a numbering cam (53) and the other end provided with a detection plate (55), the shaft (49) being provided with a slidable ring (50) to which at least one numbering box (48) is secured, (e) numbering box advancing means, (f) an ink supply means (11) in contact with the numbering box supporting cylinder (10), (g) a perforation means (82) positioned in confrontation with the numbering impression cylinder (9) to provide vertical perforations in the printed sheet (6), and (h) synchronous means operatively connected between said transfer drum (8), said numbering-impression cylinder (9) and said numbering box supporting cylinder (10) for controlling the sequential advance of said numbering box; said transfer drum (8) being adapted to transfer the printed sheet (6) from the impression cylinder (3) to the numbering-impression cylinder (9) so as to confront the printed surface of the sheet (6) with the peripheral surface of the numbering box supporting cylinder (10).

2. An offset printing machine as defined in claim 1, further comprising an underlay sheet defining the outer surface of said numbering impression cylinder (9) and a circular steel band (22) secured about said underlay in alignment with said perforation means (82) and upon which a vertical perforating operationg may be carried out, said band having an axial length smaller than that of the underlay (31).

3. An offset printing machine as defined in claim 2, wherein said perforating means (82) includes a pivotable arm (92) having a tip end and a rotary blade rotatably mounted on the tip end of said arm (28) at the position above the band (22) secured over the underlay (31).

4. An offset printing machine as defined in claim 2, further comprising a lateral-perforation cylinder (130) in confrontation with the numbering-impression cylinder (9), said lateral perforation cylinder (130) being provided with a second perforation means for forming lateral perforations in the printed sheet (6).

5. An offset printing machine as defined in claim 4, wherein an axial band (229) is formed on the underlay (31) in alignment with said second perforation means for performing lateral perforating operation, said band (229) being closely positioned beside the steel band (22) in such a manner that the band (229) is in flush with the band (22).

6. An offset printing machine as defined in claim 5, wherein the thickness of the circular band (22) is equal to that of the axial band (229).

7. An offset printing machine as defined in claim 5, wherein the outer surface of the underlay (31) is laminated with a thermoplastic film, and is formed with grid like pattern for aligning the bands (22,229) thereon.

8. An offset printing machine as defined in claim 5, wherein the second perforating means for lateral perforation comprises a rotation shaft (149), at least one lateral perforation blade (161,161') mount rings (154,155) fixedly secured to the rotation shaft (149), a holder (158,158') connected to the mount rings (154,155) for securing the blade (161,161') thereto, the blade (161,161') being shifable along radial direction of the lateral perforation cylinder (130) relative to the holder (158,158'), and said blade being adapted to confront with said band (229) upon rotation of said rotation shaft (149).

9. An offset printing machine as defined in claim 8, wherein said blade (161') is subdivided into two pieces with respect to longitudinal direction thereof, the shifting amount of said blade (161') along the radial direction of the lateral perforation cylinder (130) being independently controllable relative to the holder (158').

10. An offset printing machine as defined in claim 8 or 9, further comprising a counter-balance weight (239) fixed to the mount rings (154,155) at the position in rotational symmetry relative to the holder (158'), said weight (239) also serving to reinforce said lateral-perforation-cylinder (130).

11. An offset printing machine as defined in claim 8, wherein said mount rings (154,155) define annular space therebetween into which said holder (158,158') is slidably fixed so as to control the position of said blade (161,161') along circumferential direction of the lateral perforation cylinder (130).

12. An offset printing machine as defined in claim 4, wherein said synchronous means comprises;

(a) a solenoid (57), (b) a photoelectric sensor (56) for detecting the sheet (6) at the predetermined position of the transfer drum (8), said photoelectric sensor (56) being adapted to energize the solenoid (57) upon detection of the sheet (6), (c) a first operation arm (64) biased in contact with the cam (15) secured to one end of the shaft (14) of the transfer drum (8), a link (75) operatively connected between said operation arm (64) and said eccentric shaft (18) to control movement of said numbering impression cylinder toward the numbering-box supporting cylinder (10), (d) a first pivotal clutch (62) pivotally operable in response to the energization of the solenoid to provide engagement between the clutch (62) and one end of the operation arm (64), to thus maintain the position of the operation arm (64), (e) a second operation arm (105) biased in contact with the numbering cam (53), said second operation arm (105) being operably connected to the swingable count cam shaft (121) through an arm (119), and (f) a second clutch (103) selectively engageable with one end (105') of the second operation arm (105), said operation arms (64,105) and first and second clutches (62,103) being connected with each other by means of a linear link (99') and a clutch boss (101) in order to co-operably achieve numbering and counting operation as well as a perforating operation, said linear link (99') being normally urged to disengage the clutch (103) from the operation arm (105).

13. An offset printing machine as defined in claim 4, wherein the diameters of said lateral perforation cylinder (130), said transfer drum, said numbering-impression cylinder and said numbering-box supporting cylinder are equal to one another.

14. An offset printing machine as defined in claim 1, wherein the transfer drum (8) includes a cylinder shaft (14) rotatably secured to a frame (16,17), one end of the shaft (14) being provided with a cam (15) operatively associated with said synchronous means.

15. An offset printing machine as defined in claim 1, wherein the diameters of said transfer drum, said numbering-impression cylinder and said numbering-box cylinder are equal to one another.

16. An offset printing machine as defined in claim 1, wherein said numbering box (48) is provided with an operating lever having a roller (128) and said numbering box advancing means comprises a shaft (121), a block (124) secured to the shaft (121), and operating cam (127) secured to the block (124), said operating cam (127) being adapted to periodically contact said roller (128) of the numbering box (48) to advance the numbering.

17. An offset printing machine as defined in claim 1, wherein the eccentric shaft (18) is provided with adjustment means for adjusting the eccentric position of the eccentric shaft (18), to thereby control the distance between the eccentric shaft (18) and the shaft (49) of the numbering box supporting cylinder (10).

18. An offset printing machine as defined in any one of claims 1, 15, or 9 wherein said synchronous means comprises;

(a) a solenoid (57), (b) a photoelectric sensor (56) for detecting the sheet (6) at the predetermined position of the transfer drum (8), said photoelectric sensor (56) being adapted to energize the solenoid (57) upon detection of the sheet (6), said transfer drum (8) having a shaft (14) and a cam (15) secured to one end thereof, (c) a first operation arm (64) biased in contact with the cam (15), an eccentric shaft rotatably supporting said numbering impression cylinder, a link operatively interconnecting said arm to said eccentric shaft whereby said operation arm (64) is adapted to permit the eccentric shaft (18) to be brought into movement toward the numbering-box supporting cylinder (10) through said link (75), (d) a first pivotal clutch (62) pivotally operable in response to the energization of the solenoid (57) to provide engagement between the clutch (62) and one end of the operation arm (64), to thus maintain the position of the operation arm (64), (e) a second operation arm (105) biased in contact with the numbering box advancing means, and (f) a second clutch (103) selectively engagable with one end (105') of the second operation arm (105), pivotal arm means connecting said first and second operation arms (64,105) and the first and second clutches (62,103) with each other in order to cooperably achieve numbering and counting operations.

* * * * *